US011352101B2

(12) United States Patent
Osborn et al.

(10) Patent No.: US 11,352,101 B2
(45) Date of Patent: Jun. 7, 2022

(54) DRAG-INDUCING MAT FOR AMUSEMENT PARK RIDES

(71) Applicant: Universal City Studios LLC, Universal City, CA (US)

(72) Inventors: Byron Thomas Osborn, Tavares, FL (US); Eric Alan Vance, Orlando, FL (US); Pedro Lopez, Orlando, FL (US); Ryan Dale Walton, Orlando, FL (US); David Gerard Majdali, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 0 days.

(21) Appl. No.: 16/863,829

(22) Filed: Apr. 30, 2020

(65) Prior Publication Data

US 2020/0354028 A1 Nov. 12, 2020

Related U.S. Application Data

(60) Provisional application No. 62/845,797, filed on May 9, 2019.

(51) Int. Cl.
*B63B 32/20* (2020.01)
*A63G 21/18* (2006.01)

(52) U.S. Cl.
CPC ..... *B63B 32/20* (2020.02); *A63G 21/18* (2013.01)

(58) Field of Classification Search
CPC ..... A63G 21/00; A63G 21/18; B63B 34/50; B63B 32/50
USPC ..... 472/128–129; 441/129
See application file for complete search history.

(56) References Cited

U.S. PATENT DOCUMENTS

| | | | | |
|---|---|---|---|---|
| 4,006,503 | A * | 2/1977 | Wood | B63B 34/50 441/129 |
| 4,451,240 | A * | 5/1984 | Wood | A47C 15/006 441/129 |
| 4,634,393 | A | 1/1987 | Wood | |
| 7,648,449 | B1 * | 1/2010 | Detert | A63B 21/4037 482/111 |
| 9,138,653 | B2 | 9/2015 | Heaven et al. | |
| D781,977 | S * | 3/2017 | Lin | D21/803 |
| 2011/0159756 | A1 | 6/2011 | Shen et al. | |
| 2014/0179183 | A1 * | 6/2014 | Chiu | B63C 9/155 441/129 |

(Continued)

FOREIGN PATENT DOCUMENTS

EP 3413740 12/2018

OTHER PUBLICATIONS

PCT/US2020/031868 Invitation to Pay Add Fees dated Aug. 14, 2020.

*Primary Examiner* — Kien T Nguyen
(74) *Attorney, Agent, or Firm* — Fletcher Yoder P.C.

(57) ABSTRACT

A drag-inducing mat includes a main body configured to accommodate a rider. The main body includes a rider surface configured to face the rider and an opposing surface configured to face a slide surface. The drag-inducing mat also includes a sipe array defined within the opposing surface. The sipe array includes a plurality of sipes that extends from a first lateral edge of the main body to a second lateral edge of the main body to selectively induce friction between the main body and the slide surface based on force applied to the sipe array by the rider.

20 Claims, 5 Drawing Sheets

(56) References Cited

U.S. PATENT DOCUMENTS

| | | | |
|---|---|---|---|
| 2016/0114551 | A1 | 11/2016 | Schwartz et al. |
| 2016/0325187 | A1 | 11/2016 | Schwartz et al. |

* cited by examiner

DRAG-INDUCING MAT FOR AMUSEMENT PARK RIDES

CROSS-REFERENCE TO RELATED APPLICATION

This application claims priority to and the benefit of U.S. Provisional Application No. 62/845,797, filed May 9, 2019, and entitled "DRAG-INDUCING MAT FOR AMUSEMENT PARK RIDES," which is hereby incorporated by reference in its entirety for all purposes.

BACKGROUND

The present disclosure relates generally to the field of amusement parks. More specifically, embodiments of the present disclosure relate to equipment utilized to provide amusement park experiences.

Water parks seek to provide a variety of ride experiences for park visitors, including bumper or raft rides, water slides, log rides, water coasters, and lazy rivers. Water park attractions may be categorized by the presence and/or type of ride vehicle. For example, a children's bumper raft ride may be implemented with a soft inflatable rubber raft, while a water coaster ride may be implemented with metal car or cage-type ride vehicles similar to those in non-water roller coasters and that provide over-the-shoulder harness restraints. Other rides, such as water slides or chutes, may not have any type of vehicle. That is, the park visitors participate in the ride without being enclosed within any type of restraint or vehicle. Such rides may provide enjoyment for the visitors, because visitors sliding down a water chute may have an enhanced sensation of speed relative to a sensation that can be created within a vehicle travelling at similar speeds. However, rides that are implemented with a ride vehicle, such as a mat, may enable the visitors to achieve greater speeds along the water slide than rides without vehicles.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

Certain embodiments commensurate in scope with the originally claimed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

An embodiment is directed toward a drag-inducing mat that includes a main body configured to accommodate a rider. The main body includes a rider surface configured to face the rider and an opposing surface configured to face a slide surface. The drag-inducing mat also includes a sipe array defined within the opposing surface. The sipe array includes a plurality of sipes that extends from a first lateral edge of the main body to a second lateral edge of the main body to selectively induce friction between the main body and the slide surface based on force applied to the sipe array by the rider.

An embodiment is directed toward a method of forming a drag-inducing mat. The method includes positioning a mat adjacent to a cutting assembly. The mat includes a main body having a rider surface and an opposing surface. The method also includes moving the mat relative to the cutting assembly to define a sipe array within the opposing surface. The sipe array includes a plurality of sipes that extends from a first lateral edge of the main body to a second lateral edge of the main body. Additionally, the method includes forming the drag-inducing mat by coupling at least one handle to the rider surface of the main body at a position that enables forearms of a rider grasping the at least one handle to transmit force from the rider surface to the sipe array defined in the opposing surface during a ride.

An embodiment is directed toward a water ride system that includes a plurality of drag-inducing mats configured to accommodate a plurality of riders on a slide of the water ride system. Each drag-inducing mat of the plurality of drag-inducing mats includes a respective main body having a slide-facing surface, a rider-facing surface, and at least one handle coupled to the rider-facing surface. The plurality of drag-inducing mats includes a first set of the plurality of drag-inducing mats that each includes a first respective sipe array defined from a first lateral edge to a second lateral edge of the slide-facing surface of the respective main body. The first respective sipe array is configured to induce a first amount of drag when compressed by a respective rider of the plurality of riders. The plurality of drag-inducing mats also includes a second set of the plurality of drag-inducing mats that each includes a second respective sipe array defined from the first lateral edge to the second lateral edge of the respective main body. The second respective sipe array is configured to induce a second amount of drag, different than the first amount of drag, when compressed by the respective rider of the plurality of riders.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
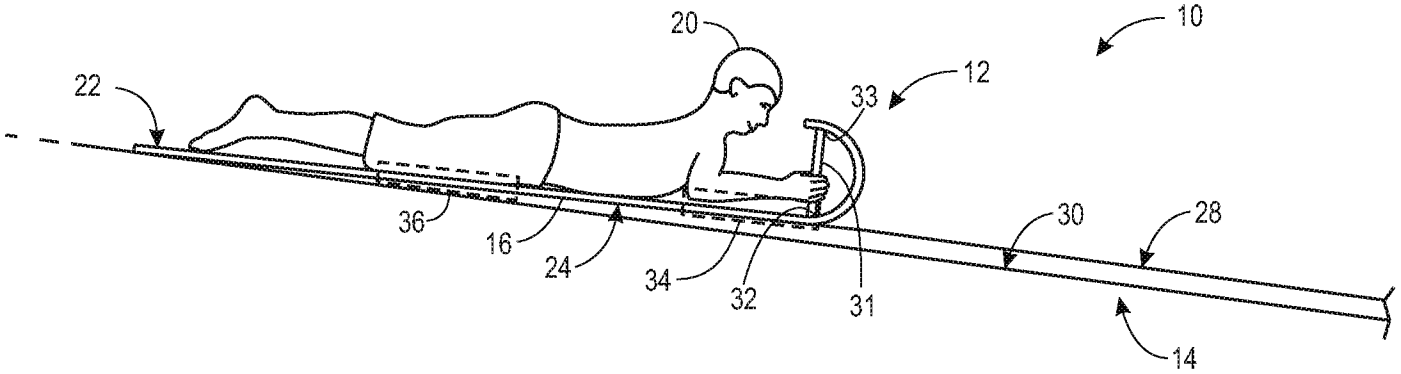
FIG. 1 is a perspective view of a water park attraction including a drag-inducing mat with a sipe array, in accordance with embodiments of the present techniques.

Reference will now be made in detail to specific embodiments illustrated in the accompanying drawings and figures. In the following detailed description, numerous specific details are set forth in order to provide a thorough understanding of the disclosure. However, it will be apparent to one of ordinary skill in the art that embodiments may be practiced without these specific details. In other instances, well-known methods, procedures, components, have not been described in detail so as not to unnecessarily obscure aspects of the embodiments.

The terminology used herein is for the purpose of describing particular embodiments only and is not intended to be limiting. As used in the description and the appended claims, the singular forms "a," "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, operations, elements, components, and/or groups thereof. Further, as used herein, the term "if" may be construed to mean "when" or "upon" or "in response to determining" or "in response to detecting," depending on the context.

The present disclosure provides drag-inducing mats that may be used in conjunction with amusement park rides. Water slides and/or chutes of amusement park rides may be typically designed for riders to enter legs first, which aligns riders according to turns of the water slide and provides for legs-first entry into a pool at the end of the water slide. However, some water slides or chutes are designed to be used with mat racers or mats, e.g., a structure that permits a rider to slide down in a forward-facing direction. In contrast to a raft or other vehicle, the mat is minimally constraining to the rider and allows the rider to feel closer to the surface of the slide, which in turn feels faster and more thrilling at relatively lower speeds as compared to vehicle-based rides. In addition, the mat may provide a shield that diverts water away from the rider's face, which in turn allows the rider to enjoy the ride with a similar level of immersion relative to a mat-free and legs-first ride. As discussed below, present embodiments include various types of mats, including those suitable for head-first or feet-first water slides.

Provided herein are drag-inducing mats with efficiently-constructible features that enable improved control of a top speed that the rider may achieve on the water slide, relative to mats without such features. For example, a drag-inducing mat may include sipes defined within a bottom surface of the drag-inducing mat that increase friction between the drag-inducing mat and a surface and/or water of the water slide. As presently recognized, the sipes may be cuts or slits within the bottom surface that improve a user-adjustable level of drag, grip, traction, and/or friction for the drag-inducing mat. As will be understood, any suitable configuration and depth of the sipes may be created to provide desired performance of the drag-inducing mat. For example, in one embodiment, the sipes may extend laterally along the bottom surface and be spaced substantially in parallel relative to one another, though as discussed below, other arrangements of the sipes are also considered herein. The sipes therefore increase a contact surface area between the drag-inducing mat and the water slide, enabling riders to more accurately control their descent along the water slide. In some embodiments, riders may select drag-inducing mats with greater sipes or fewer sipes depending on the speed at which the riders wish to experience the water slide, where drag-inducing mats with additional sipes provide more speed control. Moreover, the sipes may be formed along a full width of the drag-inducing mat, which enables an assembly line or other construction process to move a blade or hotwire across the full width for efficient sipe formation. In other embodiments, the sipes may be formed by embedding blades or baffles within an injection mold, before a molded drag-inducing mat is produced. Further, the drag-inducing mat may be strengthened for improved durability, such as by vulcanizing processes, rounding lower profiles of the sipes to control or reduce stress concentrations (e.g., stress raisers), providing a flexible sheet within the drag-inducing mat as a rip-stop, and so forth. Accordingly, the drag-inducing mat and the sipes therein may be rapidly formed, strengthened, and customized for different types of riders to improve user experience within the amusement park ride. The sipes may be very narrow (e.g., less than 1 mm wide) and thus be almost imperceptible when the drag-inducing mat is flat and/or uncompressed. However, the sipes may expand and/or move relative to one another due to rider pressure on the mat. Thus, riders of any suitable weight may increase drag with the water slide by exposing openings into the sipes, such as by pressing actively or passively on the mats.

While the disclosed embodiments are generally described in the context of water rides, water slides, or rides that include a water component, it should be understood that the drag-inducing mats, as provided herein, may also be used in other contexts and with non-water based rides. For example, the drag-inducing mats may be used on slides that do not hold any water. Further, in addition to or instead of water, the drag-inducing mats may be used in conjunction with rides that utilize foam, other liquids, snow, and so forth. In one example, the drag-inducing mats disclosed herein may be implemented as snow sleds. Accordingly, the particular construction of the mat (e.g., materials, shape, size) may be implemented according to a desired end use. Yet further, the drag-inducing mats may be implemented to accommodate a rider in either a legs-first or head-first orientation.

Keeping the above summary in mind, FIG. 1 is a perspective view of a water ride system 10 with a drag-inducing mat 12. In one embodiment, the water ride system 10 may be implemented to facilitate use of the drag-inducing mat 12 with a water slide 14 or chute. The drag-inducing mat 12 includes a main body 16 that supports a rider 20. The rider 20 generally rests on a rider-supporting surface 22 (e.g., upper surface, rider-facing surface, rider surface) of the main body 16, while a lower surface 24 (e.g., opposing surface, slide-facing surface) of the main body 16 makes direct contact with one or both of a ride surface 28 (e.g., a slide surface of the water slide 14) or the water 30 thereon. In this manner, the rider 20 is cushioned against the ride surface 28, while traveling through the water slide 14 at increased speeds compared to speeds achievable on vehicleless water ride systems. The drag-inducing mat 12 may also include additional features for rider comfort or control, such as one or more handles 31. In the present embodiment, two handles 31 are each secured between a first portion 32 and a second portion 33 of the rider-supporting surface 22, thereby forming a shield structure with a portion of the main body 16 to block water from contacting a face of the rider 20. The main body 16 of the drag-inducing mat 12 may be formed from any suitable material, including relatively flexible materials, such as foam (e.g., closed-cell), plastic, or rubber, or relatively rigid materials.

Moreover, to control the speed of the rider 20, the lower surface 24 of the main body 16 is textured via a sipe array of the drag-inducing mat 12 that increases friction between the lower surface 24 and one or both of the ride surface 28 and the water 30. Indeed, it should be understood that the drag-inducing mat 12 may cause both drag relative to the water 30 and kinetic friction relative to the ride surface 28. As discussed below, the sipe array is positioned at a connection area 34 of the main body 16, upon which the rider 20 exerts force while holding the handles 31, via his or her elbows and forearms, and in some embodiments, via the handles 31 themselves. Force that is applied to the main body 16 proximate the sipe array from the rider-supporting surface 22 of the drag-inducing mat 12 (such as the force applied by the rider's elbows when the rider 20 grasps the handles 31) may cause sipes of the sipe array to open and increase a surface area available for frictional contact with the water slide 14. However, the sipe array may be alternatively or additionally formed at a secondary connection area 36 underneath knees of the rider (where additional force is also typically applied) or in any other suitable portion of the main body 16.

As should be understood, the drag-inducing mat 12 may enable the rider 20 to selectively decrease or increase his or her speed along the ride surface 28 by pressing harder or softer on the drag-inducing mat 12, respectively. Indeed, the rider 20 may adjust the speed of the drag-inducing mat 12 by moving between various rider positions. For example, the speed may be increased when less rider weight is applied to the sipe array 50 and/or connection area 34, such as by the rider 20 lifting off of elbows, applying more weight via hips, applying more weight via knees (when using the drag-inducing mat 12 without the sipe array 50 formed underneath the knees), and so forth. Alternatively, the speed may be decreased when more rider weight is applied to the sipe array 50 and/or connection area 34, when more rider weight is applied to the secondary connection area 36, or when the rider 20 takes any other suitable position that further engages the sipe array 50 against the ride surface 28 or water 30 thereof. As such, the drag-inducing mat 12 enables the rider 20 to selectively control a descent along the ride surface 28, contributing to improved rider enjoyment.

Figure 2:
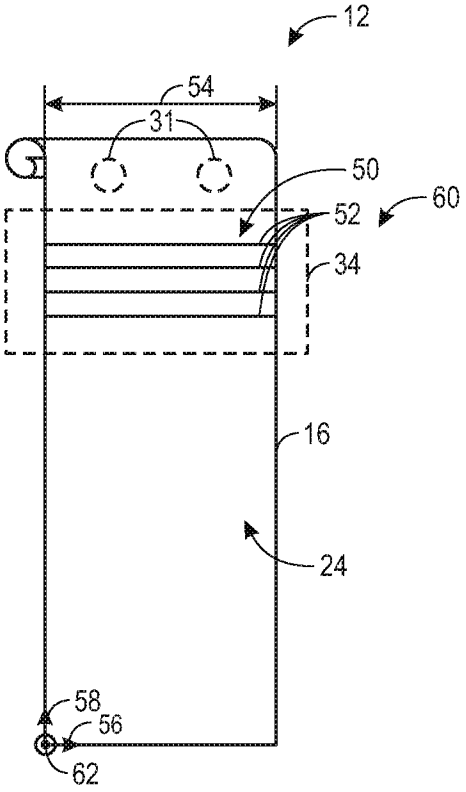
FIG. 2 is a bottom view of an embodiment of the drag-inducing mat of FIG. 1 with lateral sipes provided thereon, in accordance with embodiments of the present techniques.

FIG. 2 is a bottom view of the drag-inducing mat 12 depicting an embodiment of a sipe array 50, which is formed within the lower surface 24 of the main body 16 of the drag-inducing mat 12. As presently recognized, the sipe array 50 may be one or more sipes that improve or increase a grip of the drag-inducing mat 12 relative to the ride surface 28 and the water 30 discussed above. In the illustrated embodiment, the sipe array 50 includes four lateral sipes 52 (e.g., laterally-extending sipes, linear-shaped sipes) that each extend in a substantially straight line across a full width 54 of the main body 16, which is defined parallel to a lateral axis 56 of the drag-inducing mat 12. However, it should be understood that any suitable number of lateral sipes 52 may be included within the sipe array 50, such as two, three, four, five, six, seven, eight, or more. Additionally, as used herein, an element described as substantially straight indicates that the element is within five percent of being completely straight. Moreover, although illustrating the lateral sipes 52 with an equal spacing from one another relative to a longitudinal axis 58 of the drag-inducing mat 12, the lateral sipes 52 may alternatively be clustered closer together or further apart based on the expected pressure to be applied by the rider 20, in some embodiments. The sipe array 50 is positioned within the connection area 34 of the main body 16, which is near the handles 31 that are disposed in a top portion 60 of the drag-inducing mat 12. Therefore, due to local pressure the rider 20 may apply to the drag-inducing mat 12 during a standard ride, the sipe array 50 increases the resistance of the drag-inducing mat 12 relative to the water slide 14 to facilitate speed control for the rider 20. As an example, during a ride experience, the rider 20 may apply pressure to cause a first wall of a first lateral sipe 52 to contact the ride surface 28, while a second wall of the first lateral sipe 52 folds under itself, thereby allowing an opposing wall on an adjacent, second lateral sipe 52 to make contact with the ride surface 28. Indeed, the sipe array 50 may selectively open in any suitable manner in response to applied pressure.

As discussed in more detail below, the lateral sipes 52 may be small cuts having a width of a razor or blade (e.g., less than 1 mm, less than 0.1 mm), which may be cut into or integrally molded within the main body 16, parallel to a vertical axis 62 of the drag-inducing mat 12. That is, each lateral sipe 52 may be sized such that sipe walls of each lateral sipe 52 primarily contact one another when the drag-inducing mat 12 is not compressed by the rider 20 (e.g., provide the appearance that the lateral sipe 52 is not present, form a gap less than 1 mm wide, form a gap less than 0.1 mm wide). Moreover, compared to traditional mats that may include large grooves with a width of several centimeters, the negligible or near-zero width of the lateral sipes 52 reduces material wear and improves a useable life of the drag-inducing mat 12, while enabling selective adjustment of a contact surface area of the lower surface 24. Indeed, it is presently recognized that the sipe array 50 provides improved performance, such as greater speed control with reduced user effort, compared to these traditional mats. In some cases, the sipe array 50 may also be varied in depth across all or a portion of the full width 54 of the main body 16 discussed above to enhance or control opening of the lateral sipes 52 during use. The sipe array 50 may further be non-obvious or near invisible to the eye, in some embodiments, enhancing an aesthetic of the drag-inducing mat 12. As discussed below, the drag-inducing mat 12 may also include additional features and/or undergo specific treatments to enhance the durability of the drag-inducing mat 12.

Figure 3:
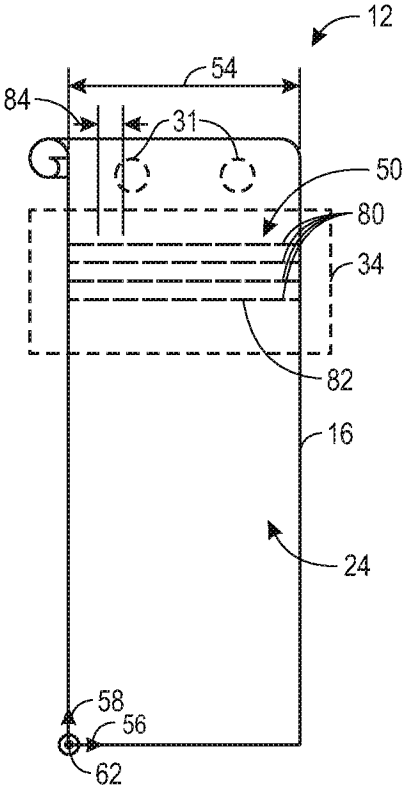
FIG. 3 is a bottom view of an embodiment of the drag-inducing mat of FIG. 1 with dashed or short lateral sipes provided thereon, in accordance with embodiments of the present techniques.

The particular shape and positioning of the sipe array 50 is customizable for multiple ride environments. That is, as recognized herein, the sipe array 50 of the drag-inducing mat 12 may take one of many suitable forms that increase drag and improve speed control of the drag-inducing mat 12. It should be understood that the sipe arrays 50 described herein may each include any suitable number, depth, and sizing of sipes, which may be constant or varied along a respective drag-inducing mat 12. Further, it should be understood that the various features of the sipe array 50 may be combined from multiple of the embodiments described herein, which may be described with reference to a single figure for clarity purposes. Indeed, any suitable configuration and depth of the sipe array 50 may be utilized to achieve a target level of performance for the drag-inducing mat 12. For example, FIG. 3 is a bottom view of the drag-inducing mat 12 in which the sipe array 50 has a staggered, dashed arrangement. That is, four lines 80 each having a number of short lateral sipes 82 (e.g., short laterally-extending sipes) are formed within the lower surface 24, in which the short lateral sipes 82 of adjacent lines 80 are staggered or offset relative to one another. In some embodiments, each short lateral sipe 82 extends along a same width portion 84 of the full width 54 of the main body 16. However, in other embodiments, the short lateral sipes 82 of each line 80 may extend along an individualized width portion 84 of the full width 54, such that short lateral sipes 82 of lines 80 more centrally positioned within the connection area 34 are longer than those more remotely positioned within the connection area 34.

Figure 4:
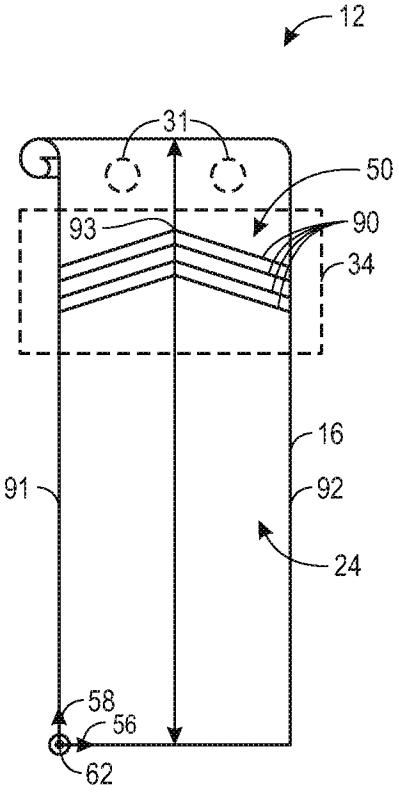
FIG. 4 is a bottom view of an embodiment of the drag-inducing mat of FIG. 1 with arrow-shaped sipes provided thereon, in accordance with embodiments of the present techniques.
Figure 6:
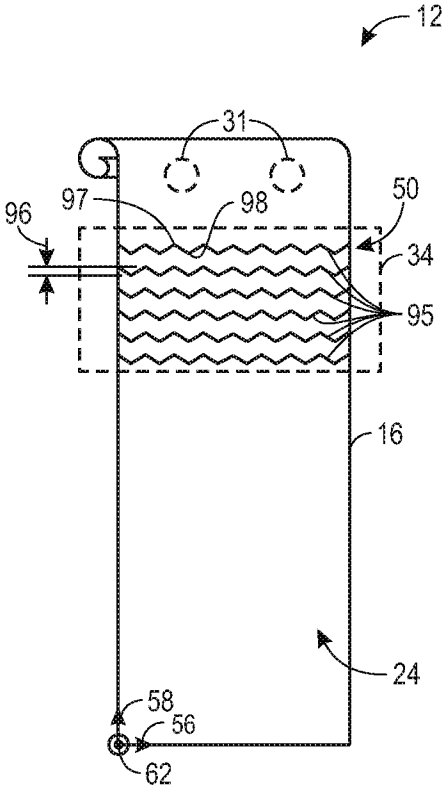
FIG. 6 is a bottom view of an embodiment of the drag-inducing mat of FIG. 1 with zig-zag-shaped sipes provided thereon, in accordance with embodiments of the present techniques.
Figure 5:
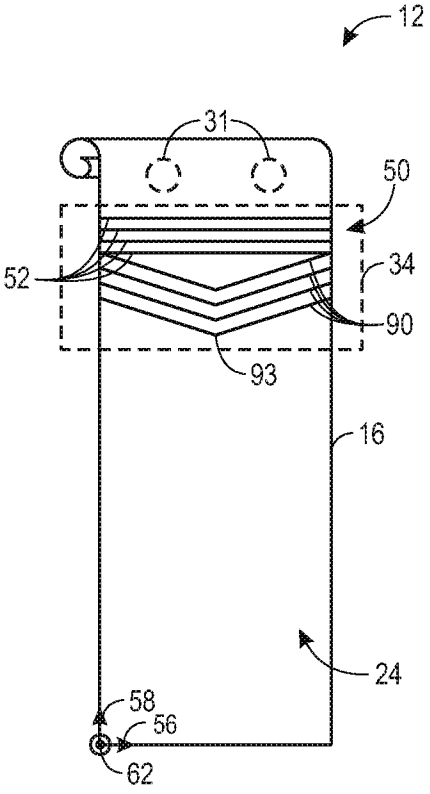
FIG. 5 is a bottom view of an embodiment of the drag-inducing mat of FIG. 1 with arrow-shaped sipes and lateral sipes provided thereon, in accordance with embodiments of the present techniques.

Moreover, FIG. 4 is a bottom view of the drag-inducing mat 12 having the sipe array 50 with an arrow or chevron arrangement. In the illustrated embodiment, the sipe array 50 includes four arrow-shaped sipes 90 that each extend from a first lateral side 91 to a second lateral side 92 of the main body 16 of the drag-inducing mat 12. The arrow-shaped sipes 90 may each include an apex 93 that intersects a longitudinally-extending centerline 94 (e.g., parallel to the longitudinal axis 58) of the main body 16 and points toward the handles 31. Further, in the embodiment of the drag-inducing mat 12 illustrated in FIG. 5, the sipe array 50 includes the arrow-shaped sipes 90 each having the apex 93 that points in an opposite direction (e.g., away from the handles 31), as well as the lateral sipes 52. By including two different types of sipes, the drag-inducing mat 12 may enable the rider 20 to further refine his or her speed. It should be understood that the arrow-shaped sipes 90 and the lateral sipes 52 may have the same or different depths defined in a direction parallel to the vertical axis 62, in certain embodiments. Further, as illustrated in the embodiment of FIG. 6, the sipe array 50 may alternatively include zig-zag-shaped sipes 95 that extend along the lower surface 24. To provide a desired density to the sipe array 50, each zig-zag-shaped sipe 95 may have any suitable sipe dimension 96 defined along the longitudinal axis 58 between adjacent peaks 97 and valleys 98 of the zig-zag-shaped sipe 95. Indeed, to provide a desired level of speed control, each rider 20 of the water slide 14 may select the drag-inducing mat 12 having the sipe array 50 with a desired density.

Figure 7:
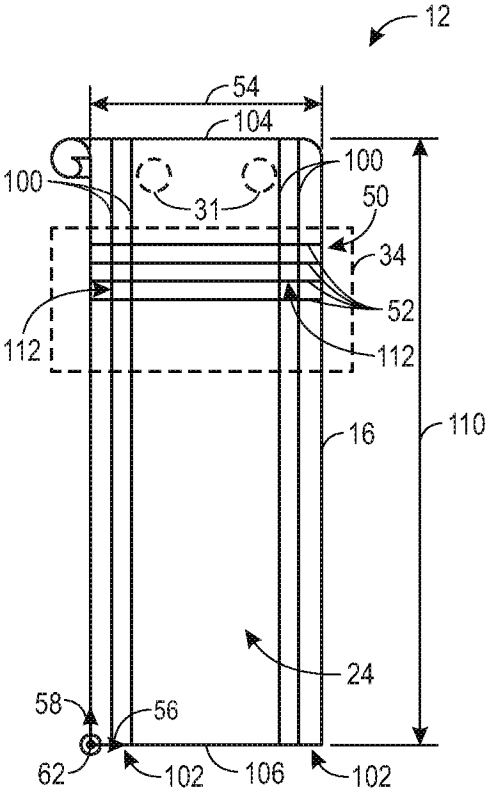
FIG. 7 is a bottom view of an embodiment of the drag-inducing mat of FIG. 1 with lateral sipes and longitudinal sipes provided thereon, in accordance with embodiments of the present techniques.

Further, as illustrated in the embodiment of the sipe array 50 of FIG. 7, longitudinal sipes 100 (e.g., longitudinally-extending sipes) may be formed in distal side portions 102 of the main body 16 of the drag-inducing mat 12. The longitudinal sipes 100 extend along a direction parallel to the longitudinal axis 58, such as from a top edge 104 to a bottom edge 106 of the main body 16. In the present embodiment, the longitudinal sipes 100 therefore traverse or intersect with the lateral sipes 52. That is, in addition to the lateral sipes 52 that extend along a direction parallel to the lateral axis 56 across the full width 54, the longitudinal sipes 100 may extend crosswise or perpendicular to the lateral sipes 52 and traverse a full length 110 of the main body 16, thereby enabling further adjustment or enlargement of a surface area of the drag-inducing mat 12 for resisting movement of the drag-inducing mat 12 along the water slide 14. This combined embodiment may create high-density sipe grids 112 proximate areas of expected elbow contact for further increased expansion of the sipes and associated drag. In some embodiments, the longitudinal sipes 100 and/or the lateral sipes 52 may be segmented to form a staggered and/or dashed plurality of sipes.

As mentioned above, it should be understood that these embodiments of the sipe array 50 are only a portion of the possible arrangements, which may be rearranged, customized, individualized, or combined in any suitable manner to provide desired speed control to the rider 20. Indeed, in other embodiments, dimples or other surface-area-increasing features and textures may also be combined with the sipe array 50. In addition, a wickerbill, spoiler, or other aerodynamic-resisting components may be combined with the sipe array 50 discussed herein. Further, sipe arrays 50 may be specifically positioned to facilitate rider control of the drag-inducing mat 12. For example, the rider 20 leaning onto or applying force to the drag-inducing mat 12 via elbows may reduce ride speed by inducing more drag, relative to the rider applying force via hips, due to the positioning of the sipe array 50. Indeed, as mentioned above, the rider 20 may control the speed of the drag-inducing mat 12 by moving into any suitable rider position that engages a selected portion of the sipe array 50 to induce drag.

Moreover, given the wide variety of sipe arrays 50 that may be provided on the drag-inducing mats 12, it should be understood that the water ride system 10 may include various sets of drag-inducing mats 12 that are each targeted for different rider qualities and/or rider experiences. For example, the drag-inducing mats 12 may be formed in sets of various sizes, such as a first set having a first length corresponding to riders 20 having a first height and a second set having a second, different length corresponding to riders 20 having a second, different height, where the sipe array 50 is sized and/or adjusted (e.g., in length, width, and/or height) to fit the individual drag-inducing mat 12. Additionally, the sets of drag-inducing mats 12 may include a high-speed set of drag-inducing mats 12 designed with a low-density sipe array 50 (e.g., the drag-inducing mats 12 of FIGS. 2, 3, and/or 4) to provide increased speeds and/or induce a decreased amount of drag, relative to a low-speed set of drag-inducing mats 12 having a high density sipe array 50 (e.g., the drag-inducing mats 12 of FIGS. 5, 6, and/or 7). As a further example, the drag-inducing mats 12 having shorter lengths may be formed with denser sipe arrays 50 than the drag-inducing mats 12 having longer lengths, thereby enabling the speed of potentially lighter riders 20 using the shorter drag-inducing mats 12 to be further controllable. In any case, by presenting the riders 20 with the potential to select between various sets of the drag-inducing mats 12, more enjoyable ride experiences may be provided and targeted to individual wishes of the riders 20.

Figure 8:
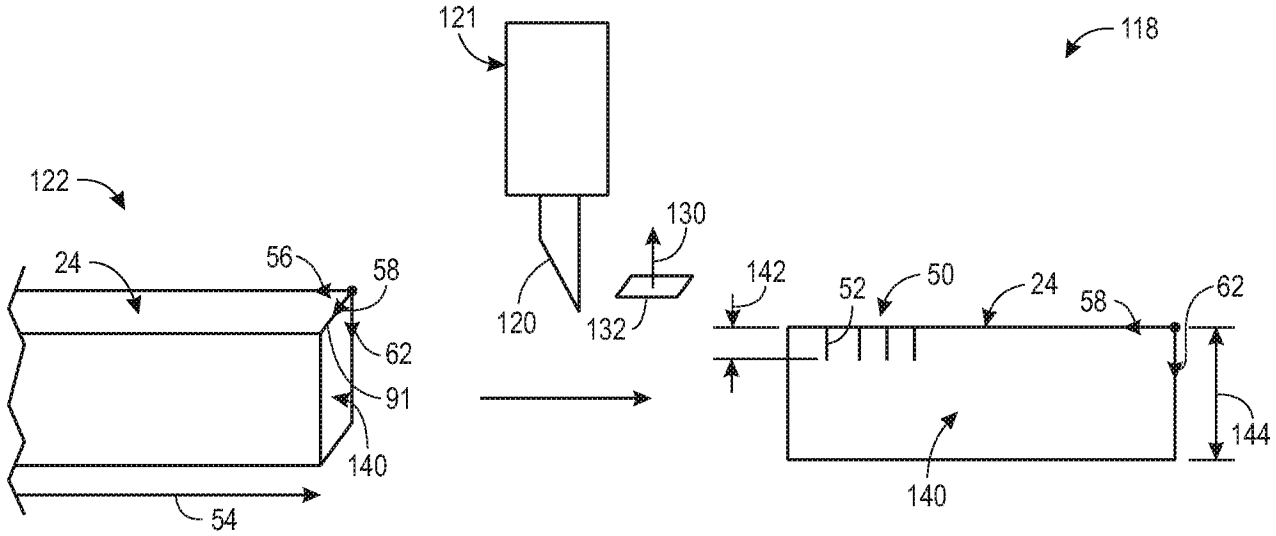
FIG. 8 is an embodiment of a cutting formation process for forming the drag-inducing mat of FIG. 1, in accordance with embodiments of the present techniques.

With the above understanding of the operation and features of the drag-inducing mat 12 in mind, discussion herein of the efficient constructability and durability of the drag-inducing mat 12 may be better understood. FIG. 8 is a perspective illustration of an embodiment of a cutting process 118 for forming the sipe array 50 of the drag-inducing mat 12. Indeed, a blade 120 (e.g., razor, heated blade, hot wire) of a cutting assembly 121 or machine may be used to form the lateral sipes 52 within the lower surface 24 of a mat 122 (e.g., a flattened or smooth mat, drag-inducing mat 12 precursor) that is positioned adjacent to the cutting assembly 121. In some embodiments, because the lateral sipes 52 or other sipe types may extend across the full width 54 of the main body 16, the blade 120 may be retained in a stationary position as the mat 122 is moved relative to the blade (e.g., in a lateral direction, in a longitudinal direction, in a vertical direction). In other embodiments, the blade 120 may be moved relative to the mat 122. For example, to form the lines 80 having multiple short lateral sipes 82, the blade 120 may pulse or move along a direction parallel to a vertical cutting axis 130 as the mat 122 is moved. Alternatively, to form the sipe array 50 with the chevron arrangement or the zig-zag-shaped sipes 95, the blade 120 may be adjusted in position along a plane 132 parallel to that of the lower surface 24 of the mat 122 as the mat 122 moves laterally relative to the blade 120. Further, in embodiments in which the blade 120 is heated or is replaced with a hotwire, the heat provided to the mat 122 may desirably melt or cauterize the sipe array 50 within the lower surface 24 for improved strength and durability. Additionally, it is presently recognized that the sipe array 50 produced by these or other processes discussed herein may be vulcanized to reduce stress raisers and control sipe opening under load.

Moreover, in some embodiments, the sipe array 50 may be formed on a surface of a composite mat before the composite mat is segmented into individual mats 122, thereby facilitating efficient formation of multiple drag-inducing mats 12. Additionally, the cutting assembly 121 may include multiple blades 120 to simultaneously form multiple sipes at once. It should be understood that a hot wire or other cutting device with a relatively small size may also be used in the cutting assembly 121 to form the sipe array 50 or to cauterize edges of the sipes to avoid tearing, in other embodiments. Additionally, in some embodiments, each sipe of the sipe array 50 may be cut simultaneously, such as by implementing the cutting assembly 121 with multiple blades 120 or hot wires.

In any case, the sipe array 50 may desirably extend from the first lateral side 91 to the second lateral side 92 of the main body 16 of the drag-inducing mat 12, such that all available space of the main body 16 is used to include the sipe array 50, which efficiently operates as a controllable friction inducer for the rider 20. Then, looking to a side surface 140 of the resulting drag-inducing mat 12, the lateral sipes 52 each have a sipe depth 142 (e.g., defined along a direction parallel to the vertical axis 62) that is a portion of a full thickness 144 of the main body 16. In some embodiments, a desirable balance is found between the resistance provided by the sipe array 50 and a material strength of the drag-inducing mat 12 when the sipe depth 142 is between 10 percent and 25 percent of the full thickness 144 of the main body 16. Thus, with the desired sipe array 50 formed, the handles 31 may be coupled to the rider-supporting surface 22 to form the drag-inducing mat 12.

Figure 9:
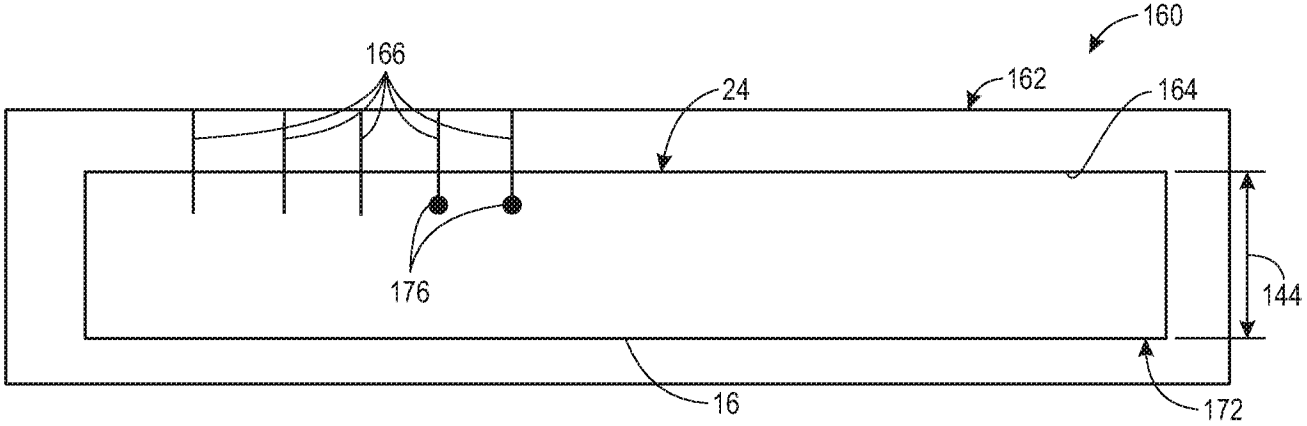
FIG. 9 is an embodiment of an injection molding process for forming the drag-inducing mat of FIG. 1, in accordance with embodiments of the present techniques.

FIG. 9 is a schematic illustration of a molding process 160 for forming the drag-inducing mat 12. For example, an injection mold 162 of the present embodiment includes an inner surface 164 that defines desired outer boundaries for the drag-inducing mat 12. Notably, baffles 166, such as blades, are embedded within the injection mold 162 to enable the sipe array 50 to be integrally formed with a material 170 of the main body 16 of the drag-inducing mat 12. That is, the baffles 166 protrude into a chamber 172 of the injection mold 162 along a full width of the injection mold 162, such that subsequent application of the material 170 from which the main body 16 is formed creates the sipe array 50 along the full width 54 of the lower surface 24 of the drag-inducing mat 12. The drag-inducing mat 12 (e.g., without handles 31) may therefore be removed from the injection mold 162 and used within the water slide 14.

Figure 10:
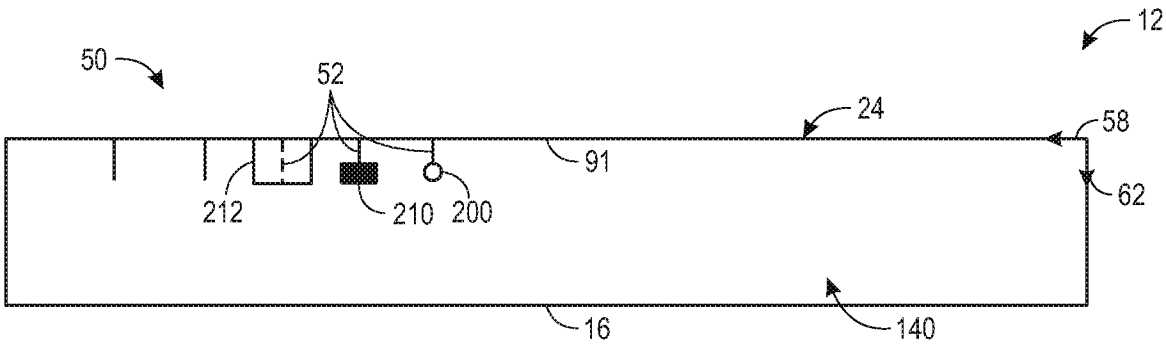
FIG. 10 is a side view of an embodiment of the drag-inducing mat formed by the injection molding process of FIG. 9, in accordance with embodiments of the present techniques.

Moreover, to inhibit or reduce potential propagation of the lateral sipes 52 along the full thickness 144 of the main body 16, certain baffles 166 or each baffle 166 of the injection mold 162 may include a bulbous end 176, in some embodiments. Therefore, as illustrated in the side view of the drag-inducing mat 12 in FIG. 10, a through-hole 200 is formed at an internal end of the lateral sipe 52 (e.g., end of the lateral sipe 52 opposite of the lower surface 24). The through-hole 200 may act as a cushion or rip-stop to absorb force that may otherwise further elongate the lateral sipe 52, thereby inhibiting ripping of the lateral sipe 52. That is, the rounded profile (e.g., inner profile) of the through-holes 200 may reduce stress raisers within the drag-inducing mat 12 that may otherwise contribute the premature wear of the drag-inducing mat 12. The rounded profile of the through-hole 200, as well as the sipe walls extending therefrom, may be vulcanized, melted, or cauterized for additional resilience. Because of the increased surface area it provides, the through-hole 200 may additionally increase the drag of the drag-inducing mat 12 compared to embodiments without the through-hole 200. Through-holes 200 may be provided with one, two, or every sipe of the sipe array 50, in some embodiments. Moreover, the through-holes 200 may have any suitable size or height relative to the sipe array 50, and the through-holes 200 may be formed by another process besides injection molding. In some embodiments, distal ends or edges of the sipe array 50 may also be rounded.

The drag-inducing mat 12 may also include other features to improve its structural strength and/or speed-controlling properties, discussed with reference to embodiments of the sipe array 50 including lateral sipes 52 for clarity. For example, when constructed via the injection mold 162, the injection mold 162 may be shaped to form a deposit 210 of the material 170 at a vertex of the main body 16 between the side surfaces 140 and the lower surface 24. As illustrated, the deposit 210 of the material 170 may therefore operate as a cushion for reducing forces that may otherwise tear the drag-inducing mat 12. Similarly, an adhesive film 212 may be applied to the side surfaces 140 to reduce undesired motion or ripping of the drag-inducing mat 12. It should be understood that, in other embodiments, the deposits 210, the adhesive films 212, and/or other materials, such as shrink fitting materials, may be utilized on each lateral sipe 52 and/or other sipe of the sipe array 50. That is, the deposits 210, the adhesive films 212, and so forth may be formed at a junction between lateral end portions of each lateral sipe 52 and lateral sides 91, 92 of the main body 16 to provide additional strength to the drag-inducing mat 12.

Figure 11:
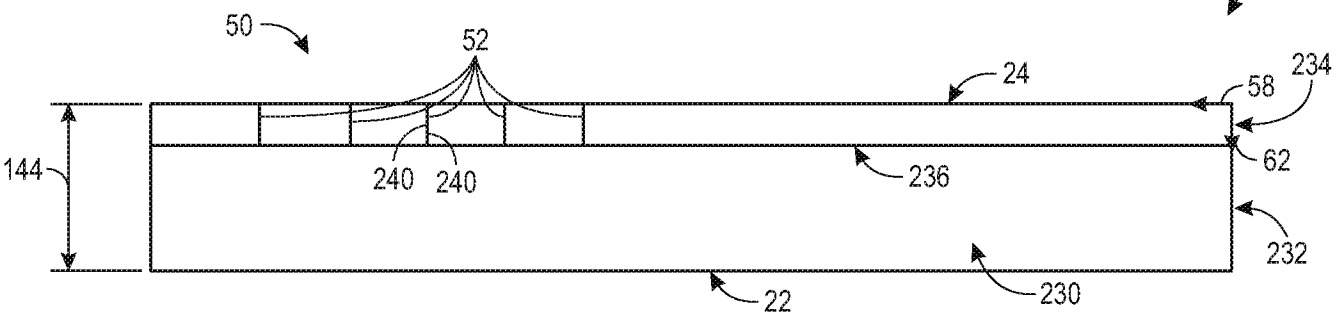
FIG. 11 is a side view of an embodiment of the drag-inducing mat of FIG. 1 having a laminated main body, in accordance with embodiments of the present techniques.

FIG. 11 is a side view of the drag-inducing mat 12 having a laminated main body 230. For example, a first layer 232 of material may be coupled to a second layer 234 of material to form the resulting laminated main body 230, which includes the rider-supporting surface 22 and the lower surface 24 discussed above. The sipe array 50 is formed within the second layer 234, which may be proportioned relative to the first layer 232 based on the desired sipe depth (e.g., 10 percent to 25 percent of the full thickness 144). As such, the laminated main body 230 prevents propagation of the lateral sipes 52 into the first layer 232. Moreover, a tough, flexible membrane 236, such as a biaxially-oriented polyethylene terephthalate (BoPET) sheet, a polytetrafluoroethylene (PTFE) sheet, or other material sheet, may be positioned between, and laminated with, the first layer 232 and the second layer 234 to prevent propagation of the lateral sipes 52 from the second layer 234 into the first layer 232. It should be understood that the flexible membrane 236 may be formed of any suitable material that is tougher or more resilient to ripping than a first material of the first layer 232 and/or a second material of the second layer 234, which may be the same or different materials. The flexible membrane 236 may be coupled between an inner surface of the first layer 232 and an inner surface of the second layer 234 by any suitable adhesive or corresponding material or, alternatively, integrally formed between the layers 232, 234 via an injection molding process. Moreover, a thickness of the flexible membrane 236 may be sized to be less than relative thicknesses of the layers 232, 234, thereby conserving utilization of the more resilient material of the flexible membrane 236 for blocking or preventing unintended propagation of the lateral sipes 52. However, other embodiments of the drag-inducing mat 12 may include the laminated main body 230 without the flexible membrane 236 disposed therein.

Additionally, as mentioned, each lateral sipe 52 includes sipe walls 240 or inner walls that are primarily in contact with one another (e.g., touching one another, nearly touching one another, indistinguishable from remaining portions of the second layer 234) when the drag-inducing mat 12 is uncompressed. Then, upon compression of the drag-inducing mat 12, the sipe walls 240 may open (e.g., fold under one another, move away from one another) to partially or fully contact the ride surface 28, as discussed above. As mentioned, the sipe walls 240 may be vulcanized, cauterized, or melted for further improved durability.

As such, technical effects of the disclosed drag-inducing mat 12 include improved, customizable rider 20 control of friction that is developed between the drag-inducing mat 12 and the water slide 14. For example, the drag-inducing mat 12 includes a main body 16 with the rider-supporting surface 22 that receives the rider 20, as well as the lower surface 24 having the sipe array 50 that is cut, molded, or otherwise defined therein. The sipe array 50 may extend along a full width 54 of the lower surface 24 and include lateral sipes 52, lines 80 of short lateral sipes 82, arrow-shaped sipes 90, zig-zag-shaped sipes 95, and/or longitudinal sipes 100. In any case, each sipe of the sipe array 50 is formed to have a notably small width, enabling the sipe walls 240 of each sipe to primarily contact one another in the absence of compression by the rider 20. Thus, as the rider 20 applies force to the drag-inducing mat 12, the sipe array 50 may selectively open to enable at least a portion of the sipe walls 240 to contact the ride surface 28 of the water slide 14, generating additional friction therebetween and contributing to increased speed control that improves rider 20 enjoyment of the water ride system 10. Because the various features of the drag-inducing mat 12 may be efficiently constructed and utilized with reduced wear, the drag-inducing mat 12 additionally improves operation of the water ride system 10, without substantial cost expenditures. For example, providing the drag-inducing mat 12 with the laminated main body 230, which may include the flexible membrane 236 therein as a rip-stop, may reduce wear of the drag-inducing mat 12 by preventing unintended propagation of the lateral sipes 52. Moreover, the drag-inducing mat 12 may be vulcanized and/or cauterized to reduce internal or external stresses and thereby control sipe opening. As such, compared to a traditional mat that may include wide, visible grooves with walls that do not contact one another, the presently disclosed drag-inducing mat 12 may provide improved rider enjoyment and increased speed control, based on the selectively increasable surface area of the sipe array 50.

While only certain features of the invention have been illustrated and described herein, many modifications and changes will occur to those skilled in the art. It is, therefore, to be understood that the appended claims are intended to cover all such modifications and changes as fall within the true spirit of the invention. While certain disclosed embodiments have been disclosed in the context of amusement or theme parks, it should be understood that certain embodiments may also relate to other uses. Further, it should be understood that certain elements of the disclosed embodiments may be combined or exchanged with one another.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A drag-inducing mat; comprising:

a main body configured to accommodate a rider, wherein the main body comprises a rider surface configured to face the rider and an opposing surface configured to face a slide surface; and a sipe array defined within the opposing surface, wherein the sipe array includes a plurality of sipes that extends from a first lateral edge of the main body to a second lateral edge of the main body, and wherein sipe walls of each sipe of the plurality of sipes are in contact with one another when the drag-inducing mat is uncompressed, and wherein the sipe walls move away from one another when the drag-inducing mat is compressed to selectively induce friction between the main body and the slide surface based on force applied to the sipe array by the rider on the rider surface.

2. The drag-inducing mat of claim 1, wherein the main body comprises one or more handles coupled to the rider surface of the main body, and wherein the sipe array is defined within the opposing surface in an area configured to receive pressure transmitted through the main body from forearms of the rider as the rider grasps the handles.

3. The drag-inducing mat of claim 1, wherein each sipe of the plurality of sipes extends through 10 percent to 25 percent of a thickness of the main body.

4. The drag-inducing mat of claim 1, wherein at least one sipe wall of the plurality of sipes is configured to at least partially contact the slide surface in response to the drag-inducing mat being compressed against the slide surface by the rider.

5. The drag-inducing mat of claim 1, wherein the sipe walls of each sipe of the plurality of sipes comprise a first sipe wall, a second sipe wall, and an inner profile extending therebetween, and wherein the first sipe wall, the second sipe wall, and the inner profile are vulcanized, cauterized, or melted.

6. The drag-inducing mat of claim 1, wherein each sipe of the plurality of sipes comprises a linear shape, a zig-zag-shape, or an arrow-shape.

7. The drag-inducing mat of claim 1, wherein the plurality of sipes is arranged along a first direction, wherein the drag-inducing mat comprises an additional plurality of sipes that is arranged along a second direction, crosswise to the first direction.

8. The drag-inducing mat of claim 1, wherein the plurality of sipes is defined within a portion of the opposing surface corresponding to an expected elbow position of the rider, and wherein the drag-inducing mat enables the rider to adjust the friction induced between the main body and the slide surface by adjusting a weight applied to the portion of the opposing surface.

9. The drag-inducing mat of claim 1, wherein the sipe array comprises a through-hole formed at an internal end of each sipe of the plurality of sipes, and wherein the sipe array is formed within the main body via an injection molding process.

10. The drag-inducing mat of claim 1, comprising:

a first layer having the rider surface;

a second layer having the opposing surface, wherein the plurality of sipes extends through a full thickness of the second layer; and a flexible membrane positioned between the first layer and the second layer to prevent propagation of the plurality of sipes from the second layer to the first layer.

11. A drag-inducing mat, comprising:

a main body configured to accommodate a rider, wherein the main body comprises a rider surface configured to face the rider and an opposing surface configured to face a slide surface; and a sipe army defined within the opposing surface, wherein the sipe array includes a plurality, of sipes that extends from a first lateral edge of the main body to a second lateral edge of the main body arranged along a first direction, and wherein the drag-inducing mat comprises an additional plurality of sipes that is arranged along a second direction, crosswise to the first direction, to selectively induce friction between the main body and the slide surface based on force applied to the sipe array by the rider.

12. The drag-inducing mat of claim 11, wherein each sipe of the plurality of sipes comprises sipe walls that are configured to contact one another when the sipe array is uncompressed.

13. The drag-inducing mat of claim 11, wherein the sipe array comprises a through-hole formed at an internal end of each sipe of the plurality of sipes.

14. The drag-inducing mat of claim 11, wherein the main body comprises one or more handles coupled to the rider surface of the main body, and wherein the sipe array is defined within the opposing surface in an area configured to receive pressure transmitted through the main body from forearms of the rider as the rider grasps the handles.

15. The drag-inducing mat of claim 11, wherein each sipe of the plurality of sipes comprises a linear shape, a zig-zag-shape, or an arrow-shape.

16. A drag-inducing mat, comprising:

a main body configured to accommodate a rider, wherein the main body comprises a first layer having a rider surface configured to face the rider and a second layer having an opposing surface configured to face a slide surface, wherein a plurality of sipes extend through a full thickness of the second layer; and a flexible membrane positioned between the first layer and the second layer to prevent propagation of the plurality of sipes from the second layer to the first layer; and a sipe array defined within the opposing surface, wherein the sipe array includes the plurality of sipes that extend from a first lateral edge of the main body to a second lateral edge of the main body to selectively induce friction between the main body and the slide surface based on force applied to the sipe array by the rider.

17. The drag-inducing mat of claim 16, wherein the sipe array comprises a through-hole formed at an internal end of each sipe of the plurality of sipes, and wherein the sipe array is formed within the main body via an injection molding process.

18. The drag-inducing mat of claim 16, wherein the main body comprises one or more handles coupled to the rider surface of the main body, and wherein the sipe array is defined within the opposing surface in an area configured to receive pressure transmitted through the main body from forearms of the rider as the rider grasps the handles.

19. The drag-inducing mat of claim 16, wherein sipe walls of each sipe of the plurality of sipes are in contact with one another when the drag-inducing mat is uncompressed, and wherein the sipe walls move away from one another when the drag-inducing mat is compressed.

20. The drag-inducing mat of claim 16, wherein each sipe of the plurality of sipes comprises a linear shape, a zig-zag-shape, or an arrow-shape.

* * * * *